US010455942B2

(12) United States Patent
Chen et al.

(10) Patent No.: US 10,455,942 B2
(45) Date of Patent: Oct. 29, 2019

(54) FOLDING CHAIR AND FOLDING SUPPORT THEREOF

(71) Applicant: Libin Chen, Jiangsu (CN)

(72) Inventors: Libin Chen, Jiangsu (CN); Qinglei Kong, Jiangsu (CN)

(73) Assignee: Libin Chen, Changzhou (CN)

( * ) Notice: Subject to any disclaimer, the term of this patent is extended or adjusted under 35 U.S.C. 154(b) by 0 days.

(21) Appl. No.: 16/019,496

(22) Filed: Jun. 26, 2018

(65) Prior Publication Data

US 2019/0290007 A1 Sep. 26, 2019

(30) Foreign Application Priority Data

Mar. 25, 2018 (CN) ..... 2018 1 0248814
Mar. 25, 2018 (CN) ..... 2018 2 0415292 U

(51) Int. Cl.
*A47C 4/28* (2006.01)
*A47C 4/48* (2006.01)
*A47C 4/30* (2006.01)

(52) U.S. Cl.
CPC ..... *A47C 4/286* (2013.01); *A47C 4/30* (2013.01); *A47C 4/48* (2013.01)

(58) Field of Classification Search
CPC ..... A47C 4/286; A47C 4/30; A47C 4/48
USPC ..... 297/45
See application file for complete search history.

(56) References Cited

U.S. PATENT DOCUMENTS 5,984,406 A * 11/1999 Lee ..... A47C 4/286 297/45 X
6,082,813 A * 7/2000 Chen ..... A47C 4/286 297/45 X
6,149,238 A * 11/2000 Tsai ..... A47C 4/286 297/45 X
6,170,907 B1 * 1/2001 Tsai ..... A47C 1/12 297/45 X
6,179,374 B1 * 1/2001 Tang ..... A47C 4/286 297/45 X
6,209,951 B1 * 4/2001 Han ..... A47C 4/286 297/45 X
6,264,271 B1 * 7/2001 Munn ..... A47C 4/286 297/45 X
6,296,304 B1 * 10/2001 Zheng ..... A47C 4/286 297/45 X
6,302,479 B1 * 10/2001 Zheng ..... A47C 4/286 297/45 X (Continued)

*Primary Examiner* — Rodney B White

(57) ABSTRACT

A folding support includes a linkage mechanism having two crossed and hinged linkage rods, and two mirror-image support mechanisms. Each support mechanism includes an upright rod, a sliding sleeve, a connector, and two diagonal bracing mechanisms. The sliding sleeve is slidably received on the upright rod. Each diagonal bracing mechanism includes a diagonal bracing rod and a bottom frame rod. An upper end of the diagonal bracing rod is hinged with the sliding sleeve, and a lower end of the diagonal bracing rod is hinged with one end of the bottom frame rod. An opposite end of the bottom frame rod is hinged with the connector, and a lower end of one linkage rod is hinged with the connector. A folding chair including the above-mentioned folding support is also disclosed. The folding chair with such folding support is easy to fold and has good supporting effect.

10 Claims, 3 Drawing Sheets

(56) References Cited

U.S. PATENT DOCUMENTS 6,322,138 B1 * 11/2001 Tang ..... A47C 4/286 297/45 X
6,371,553 B1 * 4/2002 Tang ..... A47C 4/286 297/184.1
6,382,715 B1 * 5/2002 Tang ..... A47C 4/286 297/45 X
6,402,230 B1 * 6/2002 Tang ..... A47C 1/026 297/45 X
6,454,348 B1 * 9/2002 Wu ..... A47C 4/286 297/45 X
6,601,912 B1 * 8/2003 Chen ..... A47C 4/286 297/45 X
6,629,722 B1 * 10/2003 Tang ..... A47C 7/62 297/45 X
6,634,609 B2 * 10/2003 Zheng ..... A45B 11/00 297/45 X
6,644,731 B2 * 11/2003 Tang ..... A47C 4/286 297/45 X
6,682,135 B2 * 1/2004 Zheng ..... A47C 4/286 297/45 X
6,755,462 B2 * 6/2004 Zheng ..... A47C 4/286 297/45 X
7,066,534 B2 * 6/2006 Choi ..... A47C 4/286 297/16.2
7,100,877 B2 * 9/2006 Bourke ..... A47B 37/04 297/45 X
7,229,128 B2 * 6/2007 Lee ..... A47C 4/286 297/45 X
7,240,961 B2 * 7/2007 Grace ..... A47C 4/286 297/45 X
7,641,276 B1 * 1/2010 Chen ..... A47C 4/286 297/42 X
7,845,720 B2 * 12/2010 Randall ..... A47C 4/42 297/45 X
7,878,585 B2 * 2/2011 Salisbury ..... A47C 7/744 297/45 X
8,205,934 B2 * 6/2012 Homans ..... A47C 4/02 297/45 X
8,303,032 B1 * 11/2012 Platta ..... A47C 4/286 297/45 X
8,646,835 B2 * 2/2014 Homans ..... A47C 4/02 297/45 X
8,820,825 B2 * 9/2014 Yang ..... A47C 4/286 297/45 X
8,899,673 B2 * 12/2014 Holland ..... A47C 4/286 297/45 X
9,192,235 B2 * 11/2015 Horowitz ..... A47C 1/14
9,351,578 B2 * 5/2016 Homans ..... A47C 4/30
9,625,081 B2 * 4/2017 Olander ..... F16M 11/10
2003/0071493 A1 * 4/2003 Miyagi ..... A47C 4/286 297/45 X
2003/0094836 A1 * 5/2003 Chen ..... A47C 4/286 297/42
2003/0234561 A1 * 12/2003 Zheng ..... A47C 4/02 297/45
2004/0046428 A1 * 3/2004 Hwang ..... A47C 4/286 297/16.2 X
2004/0207236 A1 * 10/2004 Chen ..... A47C 4/286 297/45
2006/0001242 A1 * 1/2006 Fulks ..... A47C 4/286 280/647
2007/0187998 A1 * 8/2007 Chen ..... A47C 4/44 297/45
2007/0267901 A1 * 11/2007 Zheng ..... A47C 4/286 297/45
2009/0224577 A1 * 9/2009 Chen ..... A47C 4/286 297/153
2010/0072790 A1 * 3/2010 Pleiman ..... A47D 1/008 297/45
2011/0006565 A1 * 1/2011 Lougee ..... A47C 4/286 297/59
2011/0018312 A1 * 1/2011 Grace ..... A47C 4/286 297/16.2
2013/0069397 A1 * 3/2013 Homans ..... A47C 4/02 297/16.1
2014/0124631 A1 * 5/2014 Olander ..... F16M 11/10 248/164
2015/0265054 A1 * 9/2015 Choi ..... A47C 4/286 297/45
2016/0022042 A1 * 1/2016 Homans ..... A47C 4/52 297/16.1
2016/0100688 A1 * 4/2016 Grace ..... A47C 4/286 297/17
2016/0296022 A1 * 10/2016 Le ..... A47C 4/286
2017/0027327 A1 * 2/2017 Homans ..... A47C 1/146
2019/0110599 A1 * 4/2019 Grace ..... A47C 4/44

* cited by examiner

FOLDING CHAIR AND FOLDING SUPPORT THEREOF

CROSS REFERENCE TO RELATED APPLICATIONS

The present application claims the benefit of Chinese Patent Application No. 201810248814.5 and Chinese Utility Model Application No. 201820415292.9, both filed on Mar. 25, 2018. All the above are hereby incorporated by reference.

TECHNICAL FIELD

The application relates to a portable chair, in particular to a folding chair and a folding support thereof.

BACKGROUND

The rocking chairs in the prior art cannot generally be folded, so it is difficult for people going out to carry.

Further, although some folding chairs are able to achieve folding, the expansion and retraction thereof are relatively complicate, and their support effect is poor. In use, because of some external forces, a case where the chair is intended to be closed up but it is not desired to be closed up is easily occurred.

Therefore, the application provides a folding chair and a folding support thereof.

SUMMARY

The technical problem to be solved by the application is to solve one of the problems pointed out in the prior art. The application provides a folding support to solve the above problem.

The technical solution adopted by the application to solve its technical problems is:

a folding support, comprising:

a linkage mechanism, the linkage mechanism comprising two linkage rods, which cross each other and are hinged;

two support mechanisms, which are disposed in a mirror image relationship on two sides of said linkage mechanism respectively, each support mechanism comprising an upright rod, a sliding sleeve, a connector, and two diagonal bracing mechanisms;

said sliding sleeves being slidably received on said upright rods, an upper end of one linkage rod being hinged with said sliding sleeve, and a lower end of the other linkage rod being hinged with a lower end of said upright rod;

said two diagonal bracing mechanisms being disposed in a mirror image relationship with respect to said upright rod, each said diagonal bracing mechanism comprising a diagonal bracing rod and a bottom frame rod, an upper end of said diagonal bracing rod being hinged with said sliding sleeve, and a lower end of said diagonal bracing rod being hinged with one end of said bottom frame rod, the other end of said bottom frame rod being hinged with said connector, and a lower end of one linkage rod is hinged with said connector.

Preferably, each sliding sleeve includes a locking mechanism, each said locking mechanism capable of preventing said sliding sleeve from sliding upward along said upright rod when said linkage mechanism and said two support mechanisms are completely expanded.

Preferably, each said locking mechanism includes a locking pin, and a through pin hole is provided on said upright rods; said through pin hole being located at an upper portion of each said sliding sleeve, and said locking pin being inserted into said through pin hole when said linkage mechanism and said two support mechanisms are completely expanded.

Preferably, a ring buckle is fixed at one end of said locking pin.

Preferably, each said locking mechanism comprises a button, a fixed shaft, a fixed housing and a spring;

said fixed housing is fixed on said sliding sleeve, said fixed shaft is mounted on said fixed housing, and said button is rotatably received on said fixed shaft;

a clamping nail is fixed on a clamping end of said button, the clamping nail penetrating out of said fixed housing; a lower surface of a pressing end of said button is fixedly connected with one end of said spring, the other end of said spring is fixedly connected with a bottom surface of said fixed housing, and said clamping end and said pressing end are located on two sides of said fixed shaft;

a blind hole for the clamping nail is provided on said upright rod;

said clamping nail is pushed into said blind hole for the clamping nail when the linkage mechanism and said two support mechanisms are completely expanded.

Preferably, the opposite ends of said bottom frame rods are hinged with said connector via fifth hinge shafts in each support mechanism;

the axis of one of said fifth hinge shafts intersects at an intersection point with the axis of the other of said fifth hinge shafts;

said intersection point in one of said support mechanisms and said intersection point in the other of said support mechanisms are located on two sides of said linkage mechanism respectively.

The application has beneficial effects that the folding support is convenient for folding and has good support effect.

The technical problem to be solved by the application is to provide a folding chair with the folding support. The application provides a folding chair to solve the above problem. A folding chair, comprising the folding support as described above, wherein a seat cushion cloth is arranged on said folding support, two sides of said seat cushion cloth are arranged in a mirror image relationship and connected with two hanging portions respectively, each of said hanging portions corresponds to one of said upright rods, two ends of each said hanging portion are fixedly connected with said seat cushion cloth, and each said hanging portion is fixed on an upper end of a corresponding one of said upright rods.

Preferably, a sleeve is fixed to a waist portion of said hanging portion, and said sleeve is received on the upper end of said upright rod.

Preferably, two armrest rods, which are disposed in a mirror image relationship on two sides of said seat cushion cloth respectively, are further comprised, each of said armrest rods corresponding to one of said hanging portions, and two ends of each said hanging portion being fixedly connected with two ends of a corresponding one of said armrest rod, respectively.

Preferably, a backrest portion for backrest is further comprised, said backrest portion being disposed along a length direction of said seat cushion cloth, and said backrest portion being fixedly connected with said seat cushion cloth.

The application has the beneficial effect that the folding chair is convenient for leaning and is convenient for people to sit and store.

BRIEF DESCRIPTION OF THE DRAWINGS

The application will be further described below with reference to the accompanying drawings and embodiments.

Figure 1:
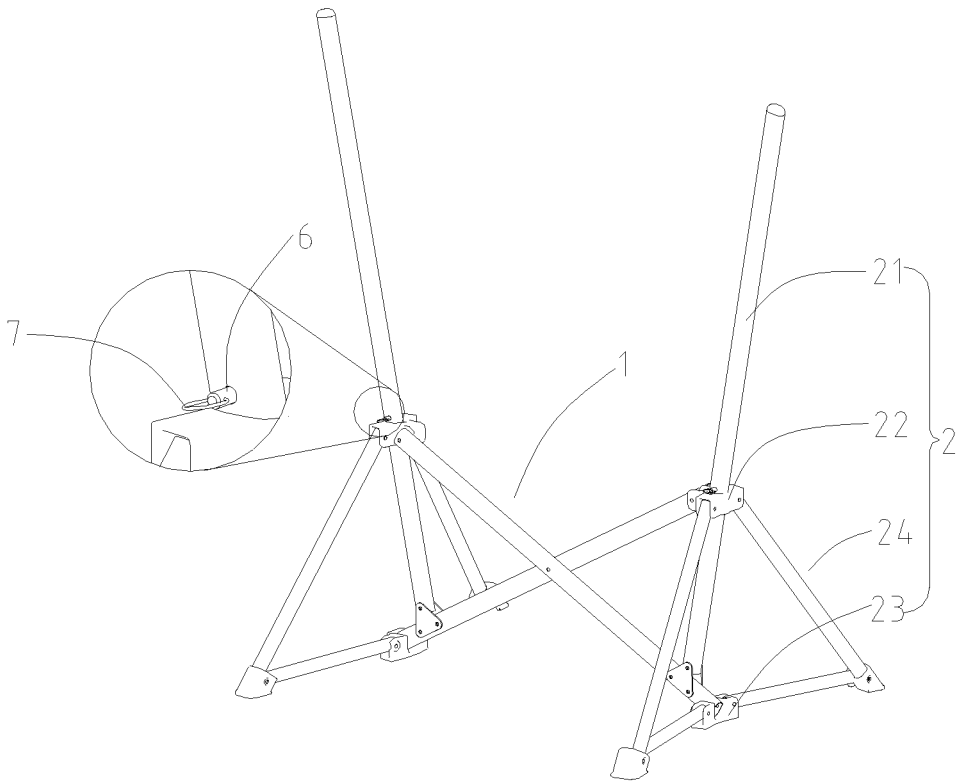
FIG. 1 is a structural schematic view of a first embodiment of a folding support according to the application.

In the figures, 1, linkage mechanism, 11, linkage rod, 2, support mechanism, 21, upright rod, 22, sliding sleeve, 23, connector, 24, diagonal bracing mechanism, 241, diagonal bracing rod, 242, bottom frame rod, 3, fixed housing, 4, button, 5, fixed shaft, 6, locking pin, 61, through pin hole, 7, ring buckle, 8, seat cushion cloth, 9, hanging portion, 91, sleeve, 10, armrest rod, 11, backrest portion.

DETAILED DESCRIPTION

The embodiments of the application are described in detail below, and examples of the embodiments are shown in the accompanying drawings, wherein the same or similar reference numerals denote the same or similar elements or elements having the same or similar functions throughout. The embodiments described below with reference to the accompanying drawings are exemplary, are only used to explain the application, and cannot be construed as limiting the application. On the contrary, the embodiments of the application include all changes, modifications and equivalents falling within the spirit and protect scope of the appended claims.

As shown in FIGS. 1 to 4, the application provides a folding support comprising: a linkage mechanism 1, the linkage mechanism 1 comprising two linkage rods 11, the two linkage rods 11 crossing each other and being hinged via a first hinge shaft, the two linkage rods 11 intersecting at a middle point thereof; two support mechanisms 2, which are disposed in a mirror image relationship on two sides of the linkage mechanism 1 respectively, each support mechanism 2 comprising an upright rod 21, a sliding sleeve 22, a connector 23 and two diagonal bracing mechanisms 24; the sliding sleeves 22 being slidably received on the upright rods 21, an upper end of one linkage rod 11 being hinged with the sliding sleeve 22 via a second hinge shaft, and a lower end of the other linkage rod 11 being hinged with a lower end of the upright rod 21 via a third hinge shaft; the two diagonal bracing mechanisms 24 being disposed in a mirror image relationship with respect to the upright rod 21, each diagonal bracing mechanism 24 comprising a diagonal bracing rod 241 and a bottom frame rod 242, an upper end of the diagonal bracing rod 241 being hinged with the sliding sleeve 22 through a fourth hinge shaft, a lower end of the diagonal bracing rod 241 being hinged with one end of the bottom frame rod 242 via a sixth hinge shaft, and the other end of the bottom frame rod 242 being hinged with the connector 23 via a fifth hinge shaft, and a lower end of one linkage rod 11 being hinged with the connector 23 via a seventh hinge shaft.

Among them, the axes of the first hinge shaft, the second hinge shaft, the third hinge shaft, and the seventh hinge shaft are parallel to each other; the axes of the fourth hinge shaft, the fifth hinge shaft, and the sixth hinge shaft are parallel to each other, and the included angle between the second hinge shaft and the fourth hinge shaft is not 0. At the lower end of the diagonal bracing rod 241, there are also supporting legs for ground support.

This folding support further comprises at least one locking mechanism, each locking mechanism corresponding to one sliding sleeve 22.

When the linkage mechanism 1 and the two support mechanisms 2 are completely expanded, the locking mechanism can prevent the sliding sleeve 22 corresponding to it from sliding upward along the upright rod 21. "Completely expanded" mentioned herein means that the linkage mechanism 1 is opened to the maximum state and can no longer be opened, and the state of the support mechanism 2 is the same as that of the linkage mechanism 1.

As shown in FIG. 1, the locking mechanism comprises a locking pin 6, and a through pin hole 61 is provided on the upright rod 21. The through pin hole 61 here refers to penetrate through the upright rod 21, and this kind of locking effect is relatively good.

When the linkage mechanism 1 and the two support mechanisms 2 are completely expanded, the through pin hole 61 is located at an upper portion of the sliding sleeve 22, and the locking pin 6 is inserted into the through pin hole 61. "The through pin hole 61 is located at the upper portion of the sliding sleeve 22" mentioned herein means that the locking pin 6 is inserted into the through pin hole 61, and due to the presence of the body of the locking pin 6, the sliding sleeve 22 cannot slide upward along the upright rod 21, that is, the entirety of the linkage mechanism 1 and the support mechanism 2 cannot be closed up. Of course, in order to facilitate the insertion of the locking pin 6, when the locking pin 6 is inserted into the through pin hole 61, the body of the locking pin 6 and the upper surface of the sliding sleeve 22 may still have a certain gap, and the presence of the gap is only able to achieve a slight upward movement of the sliding sleeve 22.

A ring buckle 7 is fixed to one end of the locking pin 6. Provision of the ring buckle 7 is (i) to facilitate the removal and insertion of the locking pin 6, and (ii) to prevent the locking pin 6 from being inserted too deep so that a head of the locking pin 6 can fall into an inner cavity of the upright rod 21, thereby causing the entirety of the locking pin 6 to fall into it. Here, the locking pin 6 and the through pin hole 61 are in a close-fitting state.

Of course, in order to facilitate carrying, the locking pin 6 here can be connected to the sliding sleeve 22 through the connecting wire to prevent it from being lost. Of course, the connection form is not unique, and it can also be plugged into the sliding sleeve 22, or it can be connected through a flexible connection line. It can also be movably hung on the sliding sleeve by a ring so that the locking pin 6 will not be lost.

Figure 2:
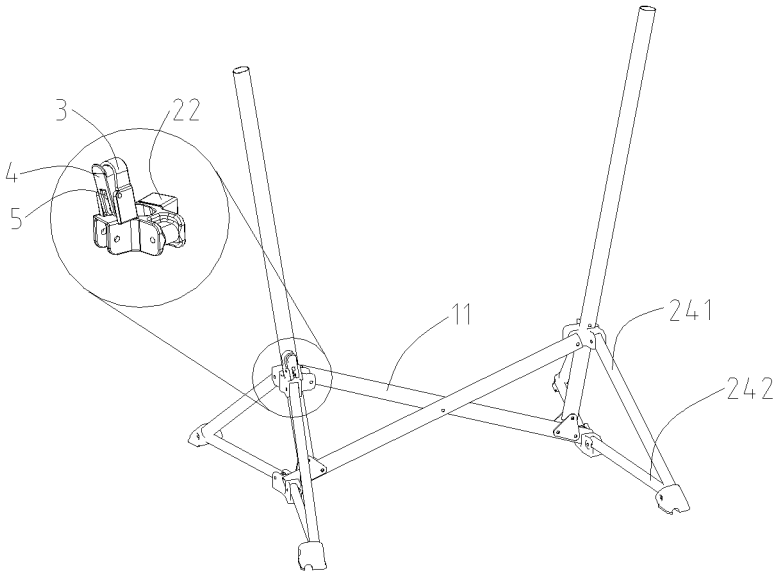
FIG. 2 is a structural schematic view of a second embodiment of a folding support according to the application.
Figure 3:
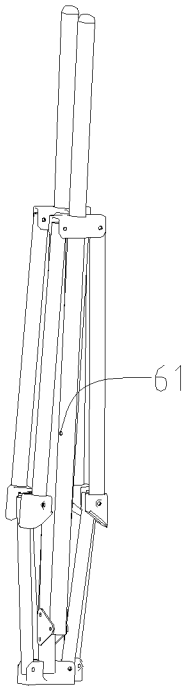
FIG. 3 is a structural schematic view of a folding support according to the application when it is folded.
Figure 4:
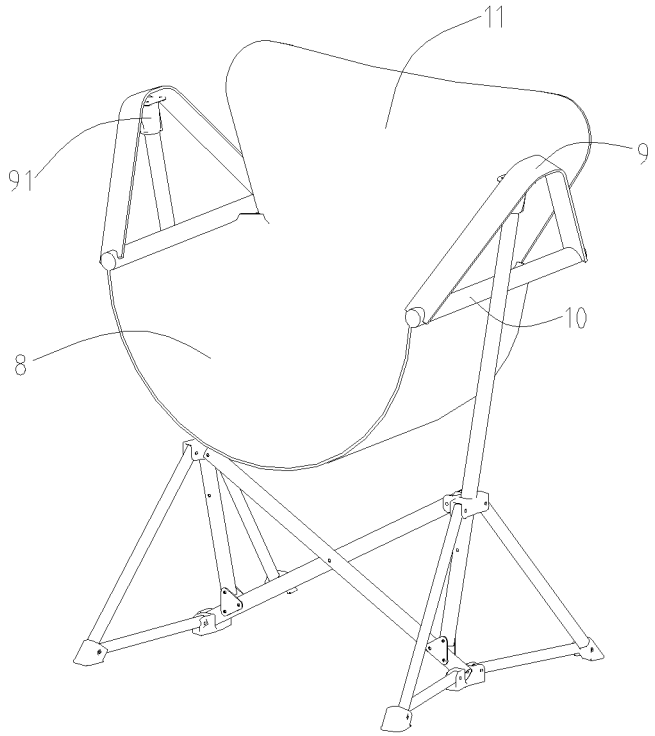
FIG. 4 is a structural schematic view of a preferred embodiment of a folding chair according to the application.

As shown in FIG. 2, each locking mechanism comprises a button 4, a fixed shaft 5, a fixed housing 3 and a spring (not shown in the figure); the fixed housing 3 is fixed on the sliding sleeve 22, and the fixed shaft 5 is mounted on the fixed housing 3, and the button 4 is rotatably received on the fixed shaft 5; a clamping nail (not shown in the figure) is fixed on a clamping end of the button 4, and the clamping nail (not shown in the figure) extending outwardly of the fixed housing 3; a lower surface at a pressing end of the button 4 is fixedly connected with one end of the spring (not shown in the figure), the other end of the spring (not shown in the figure) is fixedly connected with the bottom surface of the fixed housing 3, and the clamping end and the pressing end are located at two sides of the fixed shaft 5; the upright rod 21 is provided with a blind hole for the clamping nail.

Here, when the linkage mechanism 1 and the two support mechanisms 2 are unfolded, the clamping nail (not shown in the figure) abuts against an outer wall of the upright rod 21 while the spring (not shown in the figure) is in a compressed state. However, in the process where the slide sleeve 22 continues to slide downward, when the clamping nail (not shown in the figure) moves to the blind hole for the clamping nail, under the action of the spring (not shown in the figure), the clamping nail (not shown in the figure) is pushed into the blind hole for the clamping nail. When it is required to retract, it can be achieved only by pressing a pressing portion of the button 4. The blind hole for the clamping nail here is in communication with the inner cavity of the upright rod 21.

When the linkage mechanism 1 and the two support mechanisms 2 are completely expanded, the clamping nail (not shown in the figure) is pushed into the blind hole for the clamping nail.

The end portion of the bottom frame rod 242 is hinged with the connector 23 through the fifth hinge shaft; in the same support mechanism 2, the axis of one fifth hinge shaft intersects at an intersection point with the axis of the other fifth hinge shaft; and the intersection point of one support mechanism 2 and the intersection point of the other support mechanism 2 are located on two sides of the linkage mechanism 1. Herein, it is pointed out that by this arrangement, the position of the fifth hinge shaft can make the two diagonal bracing mechanisms 24 combine with the upright pole 21 to form a triangular pyramid shape, thereby further enhancing the supporting strength thereof.

A folding chair, comprising the folding support as described above, wherein a seat cushion cloth 8 is arranged on said folding support, two sides of the seat cushion cloth 8 are arranged in a mirror image relationship and connected with two hanging portions 9 respectively, each of said hanging portions 9 corresponds to one upright rod 21, two ends of the hanging portion 9 are fixedly connected with the seat cushion cloth 8, and the hanging portion 9 is fixed on an upper end of the upright rod 21. Here, the seat cushion cloth 8 is in an arc shape and is pulled downward to form a U-shape, and this arrangement is convenient for people to sit down.

A sleeve 91 is fixed to a waist portion of the hanging portion 9, and the sleeve 91 is received on the upper end of the upright rod 21. The connection between the hanging portion 9 and the upper end of the upright rod 21 is not limited to the above sleeve 91. Of course, various connection types such as bolts or rivets may be used.

The folding chair further comprises two armrest rods 10, two armrest rods 10 disposed in a mirror image relationship on two sides of the seat cushion cloth 8 respectively, each armrest rod 10 corresponding to one hanging portion 9, two ends of each hanging portion 9 fixedly connected with two ends of a corresponding one of the armrest rods 10, respectively.

The folding chair further comprises a backrest portion 11 for backrest. The backrest portion 11 is disposed along a length direction of the seat pad 8 and the backrest portion 11 is fixedly connected to the seat cushion cloth 8. Here, the backrest portion 11 completely blocks the U-shaped opening of the U-shaped seat cushion cloth 8, and then the backrest portion 11 is nearly parallel to the vertical direction, which is thereby convenient for the people to lean.

Based on the above description of the ideal embodiments of the application, through the above description, those skilled in the art can completely make various changes and modifications without departing from the technical idea of the application. The technical scope of this application is not limited to the content of the description, and must be determined according to the scope of claims.

What is claimed is:

1. A folding support, comprising:

a linkage mechanism, the linkage mechanism comprising two linkage rods which cross each other and are hinged;

two support mechanisms, which are disposed in a mirror image relationship on two sides of said linkage mechanism respectively, each support mechanism comprising an upright rod, a sliding sleeve, a connector, and two diagonal bracing mechanisms;

said sliding sleeves being slidably received on said upright rods, an upper end of one linkage rod being hinged with said sliding sleeve, and a lower end of the other linkage rod being hinged with a lower end of said upright rod;

said two diagonal bracing mechanisms being disposed in a mirror image relationship with respect to said upright rods, each said diagonal bracing mechanism comprising a diagonal bracing rod and a bottom frame rod, an upper end of said diagonal bracing rod being hinged with said sliding sleeve, and a lower end of said diagonal bracing rod being hinged with one end of said bottom frame rod, an opposite end of said bottom frame rod being hinged with said connector, and a lower end of one linkage rod is hinged with said connector.

2. The folding support of claim 1, wherein each sliding sleeve comprises a locking mechanism, each said locking mechanism capable of preventing said sliding sleeve from sliding upward along said upright rod when said linkage mechanism and said two support mechanisms are completely expanded.

3. The folding support of claim 2, wherein each said locking mechanism comprises a locking pin, and a through pin hole is provided on said upright rods; said through pin hole being located at an upper portion of each said sliding sleeve, and said locking pin being inserted into said through pin hole when said linkage mechanism and said two support mechanisms are completely expanded.

4. The folding support of claim 3, wherein a ring buckle is fixed at one end of said locking pin.

5. The folding support of claim 2, wherein each said locking mechanism comprises a button, a fixed shaft, a fixed housing and a spring;

said fixed housing is fixed on said sliding sleeve, said fixed shaft is mounted on said fixed housing, and said button is rotatably received on said fixed shaft;

a clamping nail is fixed on a clamping end of said button, the clamping nail extending outwardly of said fixed housing; a lower surface of a pressing end of said button is fixedly connected with one end of said spring, an opposite end of said spring is fixedly connected with a bottom surface of said fixed housing, and said clamping end and said pressing end are located on two sides of said fixed shaft;

a blind hole for receiving the clamping nail is provided on said upright rod;

said clamping nail is inserted into said blind hole for receiving the clamping nail when the linkage mechanism and said two support mechanisms are completely expanded.

6. The folding support of claim 1, wherein the opposite ends of said bottom frame rods are hinged with said connector via hinge shafts in each support mechanism;

an axis of one of said hinge shafts intersects at an intersection point with an axis of another one of said hinge shafts;

said intersection point in one of said support mechanisms and said intersection point in another one of said support mechanisms are located on two sides of said linkage mechanism respectively.

7. A folding chair, comprising the folding support of claim 1, wherein a seat cushion cloth is arranged on said folding support, two sides of said seat cushion cloth are arranged in a mirror image relationship and connected with two hanging portions respectively, two ends of each said hanging portion are fixedly connected with said seat cushion cloth, and each said hanging portion is fixed on an upper end of a corresponding one of said upright rods.

8. The folding chair of claim 7, wherein a sleeve is fixed to a waist portion of said hanging portion, and said sleeve is received on the upper end of said upright rod.

9. The folding chair of claim 7, further comprising two armrest rods, which are disposed in a mirror image relationship on two sides of said seat cushion cloth respectively, each of said armrest rods corresponding to one of said hanging portions, and two ends of each said hanging portion being fixedly connected with two ends of a corresponding one of said armrest rods, respectively.

10. The folding chair of claim 9, further comprising a backrest portion for backrest, said backrest portion being disposed along a length direction of said seat cushion cloth, and said backrest portion being fixedly connected with said seat cushion cloth.

* * * * *